US006802310B1

(12) United States Patent
Yeung

(10) Patent No.: US 6,802,310 B1
(45) Date of Patent: Oct. 12, 2004

(54) KITCHEN RANGE HOOD WITH PERIMETER AIR INLET

(76) Inventor: Peter Yeung, 4446 Frances Street, Burnaby, British Columbia (CA), V5C 2R4

( * ) Notice: Subject to any disclaimer, the term of this patent is extended or adjusted under 35 U.S.C. 154(b) by 0 days.

(21) Appl. No.: 10/445,223

(22) Filed: May 27, 2003

(51) Int. Cl.[7] ..... F24C 15/20

(52) U.S. Cl. ..... 126/299 D; 126/299 R; 126/299 E

(58) Field of Search ..... 126/299 R, 299 D, 126/299 E; 454/67, 49, 99, 139; 55/DIG. 36

(56) References Cited

U.S. PATENT DOCUMENTS 5,163,869 A * 11/1992 Yeh et al. ..... 454/67
5,370,498 A 12/1994 Klingler
5,372,122 A 12/1994 Hong et al.
5,448,987 A 9/1995 Jang
5,628,289 A 5/1997 Chang
5,979,436 A 11/1999 Chiang et al.
6,361,428 B1 * 3/2002 Tosconi et al. ..... 454/137
6,401,709 B1 6/2002 Okamoto et al.

* cited by examiner

*Primary Examiner*—Jiping Lu
(74) *Attorney, Agent, or Firm*—Paul Smith Intellectual Property Law; Paul Smith

(57) ABSTRACT

A range hood for exhausting gases generated above a cooking surface comprises an outer hood body within which a motor housing is mounted. The motor housing has top, bottom and perimeter side surfaces defining a substantially cylindrical chamber within which a motor and fan are housed. The motor housing has an air outlet and at least one air inlet, the air inlet being located about the perimeter of the housing so as to draw in air from below the range hood. A panel is connected to the bottom of the hood body. The range hood may also be equipped with an automatic cleaning system. A further air intake may also be located in the bottom of the motor housing aligned with the fan.

12 Claims, 9 Drawing Sheets

KITCHEN RANGE HOOD WITH PERIMETER AIR INLET

FIELD OF THE INVENTION

This invention relates to range hoods for use in domestic kitchens for exhausting smoke and gases above a cooking surface, and more particularly to a range hood adapted for drawing in air about the periphery of the range hood bottom.

BACKGROUND OF THE INVENTION

The removal of grease and smoke filled air from above a cooking surface is important in order to improve the quality of the air being breathed in by the occupants of the cooking environment. The exhausting of these unwanted gases is accomplished through use of a kitchen range hood. The range hood is positioned above the cooking surface to remove grease, common odors and hazardous gases created during the cooking process. There are a wide variety of range hoods available, but they typically comprise one or two openings formed in the bottom of the range hood and a comparable number of devices (motor and fan) for drawing the unwanted gases through the opening(s).

An example of the single opening design is shown in U.S. Pat. No. 4,500,331. The '331 patent teaches a motor housing having top and bottom surfaces, a curved outer wall and an extended end portion. There is an air inlet opening in the bottom surface and an air outlet in the top surface in the area of the extended end portion. An electric motor is mounted to the top of the housing and a centrifugal fan attached to it. The motor and fan are positioned directly above the air inlet and when in operation act to draw gases into the motor housing through the air inlet.

In the double opening design, the motor housing has top, bottom and perimeter side surfaces defining an enclosure having two substantially mirror chambers, each with an air inlet at the bottom and an air outlet at the top. A motor and fan is positioned in each chamber directly above the air inlet. The fans suck air from the cooking area below and force it through the motor housing chambers to the air outlet where it is directed by ventilation piping to another location, typically the building exterior.

The difficulty with both the single and the double opening designs is that not all of the gases rising from the cooking surface will be drawn through the opening(s). Some of the gases rising from the cooking surface flow around the sides or front of the range hood and remain present in the cooking environment.

Accordingly, it is an object of an embodiment of the invention to provide a range hood adapted for drawing in air about the periphery of the range hood bottom.

It is a further object of an embodiment of the invention to provide a range hood adapted for drawing in air about the periphery of the range hood bottom that is self-cleaning.

Not all aspects of the invention necessarily address such objects. Other objects of the invention will be apparent from the description that follows.

SUMMARY OF THE INVENTION

According to the preferred embodiment of the present invention there is provided a range hood for exhausting gases comprising an outer hood body and a motor housing having top, bottom and perimeter surfaces defining an enclosure and having an air outlet and at least one air inlet. The motor housing is mounted within the hood body; and a motor and fan are mounted within the motor housing. The air inlet is located in the perimeter surface of the motor housing.

The range hood has a hood body comprising top, front, rear and side surfaces. A framing panel is connected to the hood body, a portion of the panel being in abutment with the motor housing. The framing panel has a substantially planar portion and a peripheral wall substantially perpendicular thereto. At least one opening is located in the wall.

The opening in the wall is positioned and sized to align with the air inlet in the motor housing. Where there are multiple air inlets, adjacent air inlets are separated by an intermediate member.

In another aspect, the range hood described above further comprises a lower panel. The lower panel is connected to the framing panel and to the hood body. In another aspect, the range hood described above further comprises cleaning fluid delivery means. The cleaning fluid delivery means preferably comprises a spray nozzle and a conduit connected to the spray nozzle. The spray nozzle may be mounted in the motor housing or seated on a support stand mounted within the motor housing.

According to an alternative embodiment of the invention there is provided a range hood for exhausting gases comprising an outer hood body and a motor housing having top, bottom and perimeter surfaces defining an enclosure and having an air outlet and at least one air inlet. The motor housing is mounted within the hood body; and a motor and fan are mounted within the motor housing. The air inlet is located in the perimeter surface of the motor housing. An additional air intake is located in the bottom of the motor housing.

The foregoing was intended as a broad summary only and of only some of the aspects of the invention. It was not intended to define the limits or requirements of the invention. Other aspects of the invention will be appreciated by reference to the detailed description of the preferred embodiment and to the claims.

BRIEF DESCRIPTION OF THE DRAWINGS

The invention will be described by reference to the detailed description of the preferred embodiment and to the drawings thereof in which.

DETAILED DESCRIPTION OF THE PREFERRED EMBODIMENT

Figure 1:
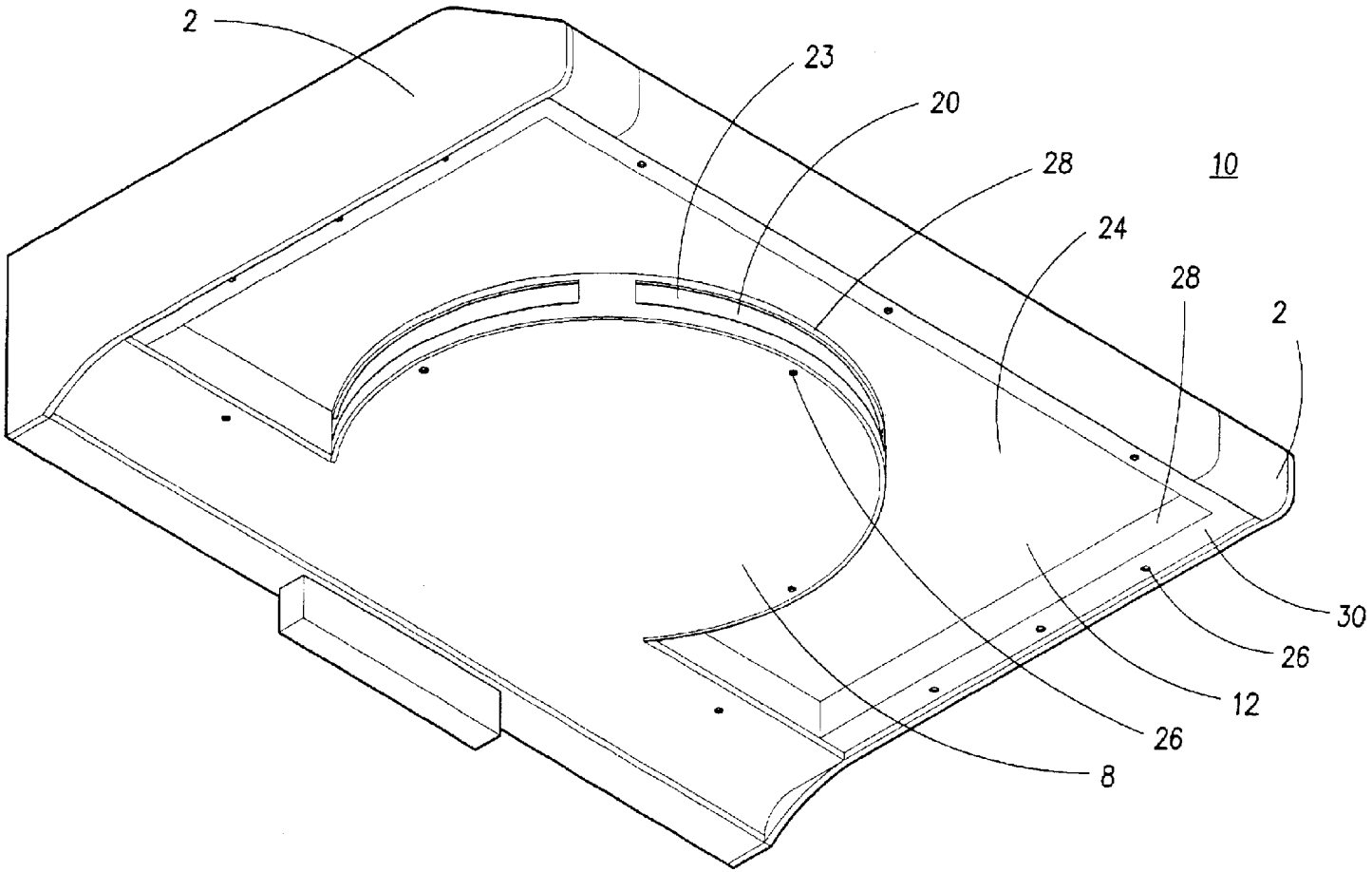
FIG. 1 is a perspective view from the bottom of a range hood according to the preferred embodiment of the invention.
Figure 2:
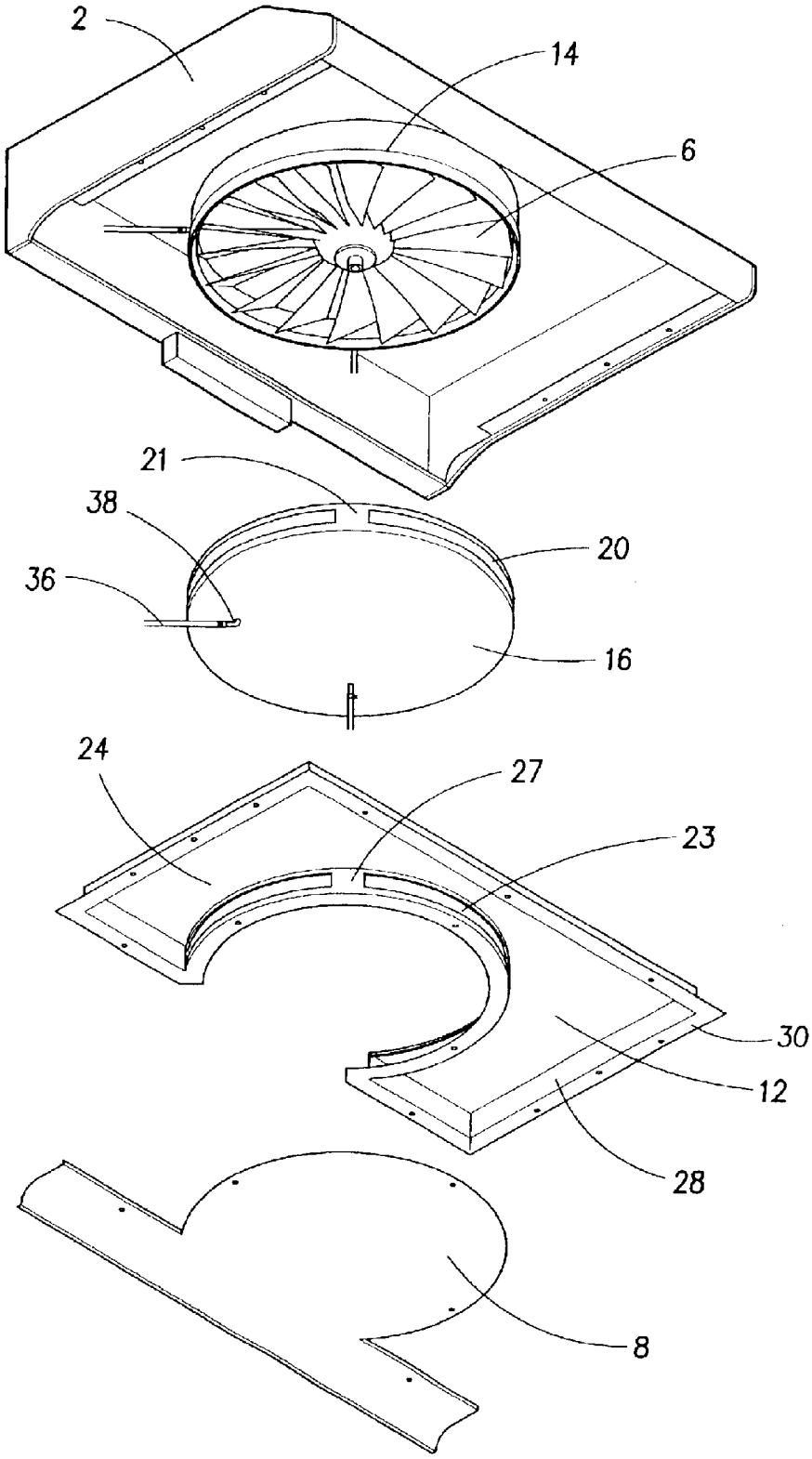
FIG. 2 is an exploded perspective view of the range hood of FIG. 1.
Figure 3:
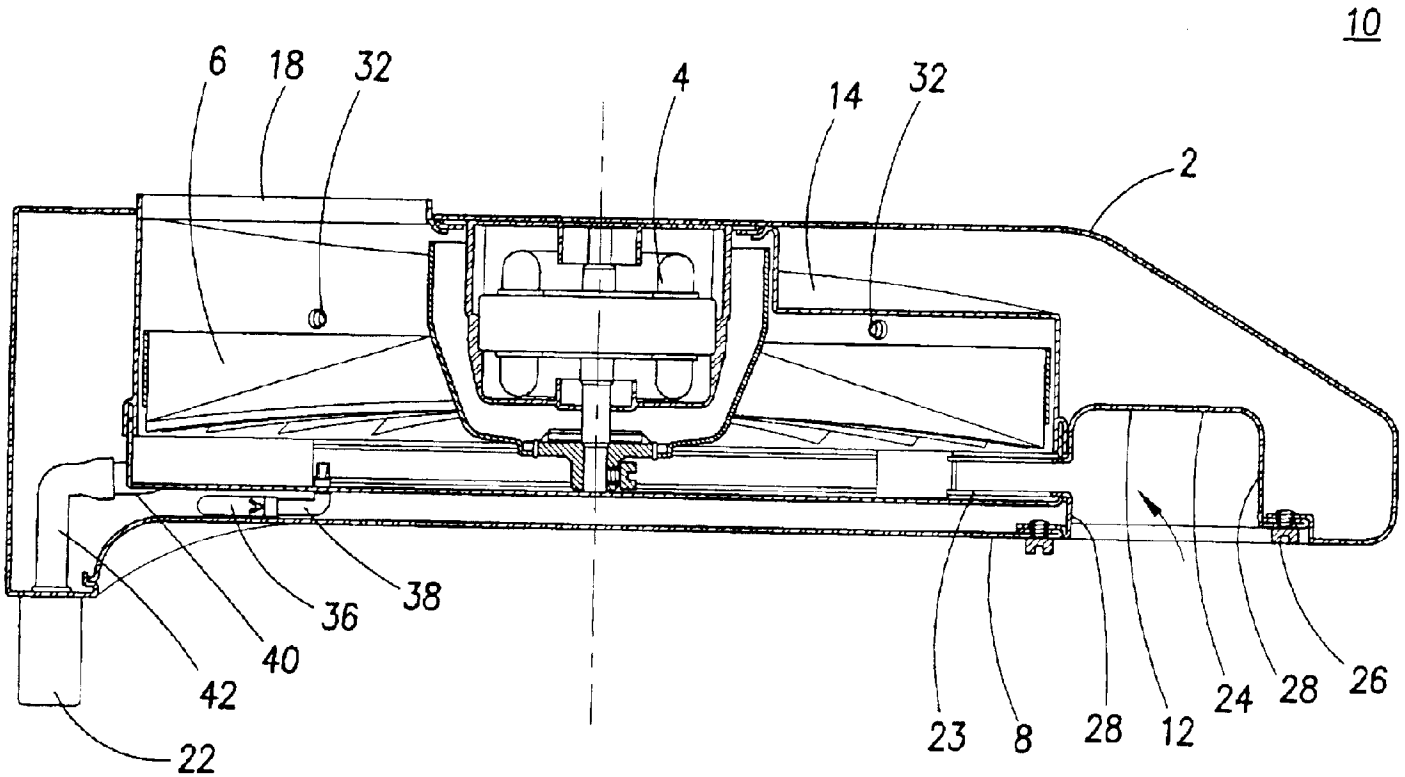
FIG. 3 is a side cross sectional view of the range hood of FIG. 1.

The present invention relates to a kitchen range hood and in particular a range hood having peripheral air inlets through which the grease filled air above a cooking surface may be drawn into the range hood to be exhausted to an external location.

The preferred embodiment of a peripheral air inlet equipped range hood 10 is illustrated in FIGS. 1–4. The range hood has an outer hood body 2 defining top, front, rear and side surfaces and forming the outer shell of an enclosure, as shown best in FIG. 2. Typically the outer hood body is formed of metal sections that have been folded and welded together in order to form the box like shape shown in the drawings.

A motor housing 5 having top, bottom and perimeter side surfaces defining an enclosed air chamber is mounted within the range hood enclosure. Preferably, the motor housing is substantially cylindrical and has an upper section 14 and a lower section 16 that may be connected together. A motor 4 is mounted within the upper section 14 of the motor housing 5. Both the motor 4 and the motor housing 5 are adapted to be removably attached to the hood body 2. A fan 6 may be removably connected to the motor 4. The fan is sized such that there is a minimal amount of space between the radial outer edge of the fan and the perimeter side wall of the motor housing.

Figure 4:
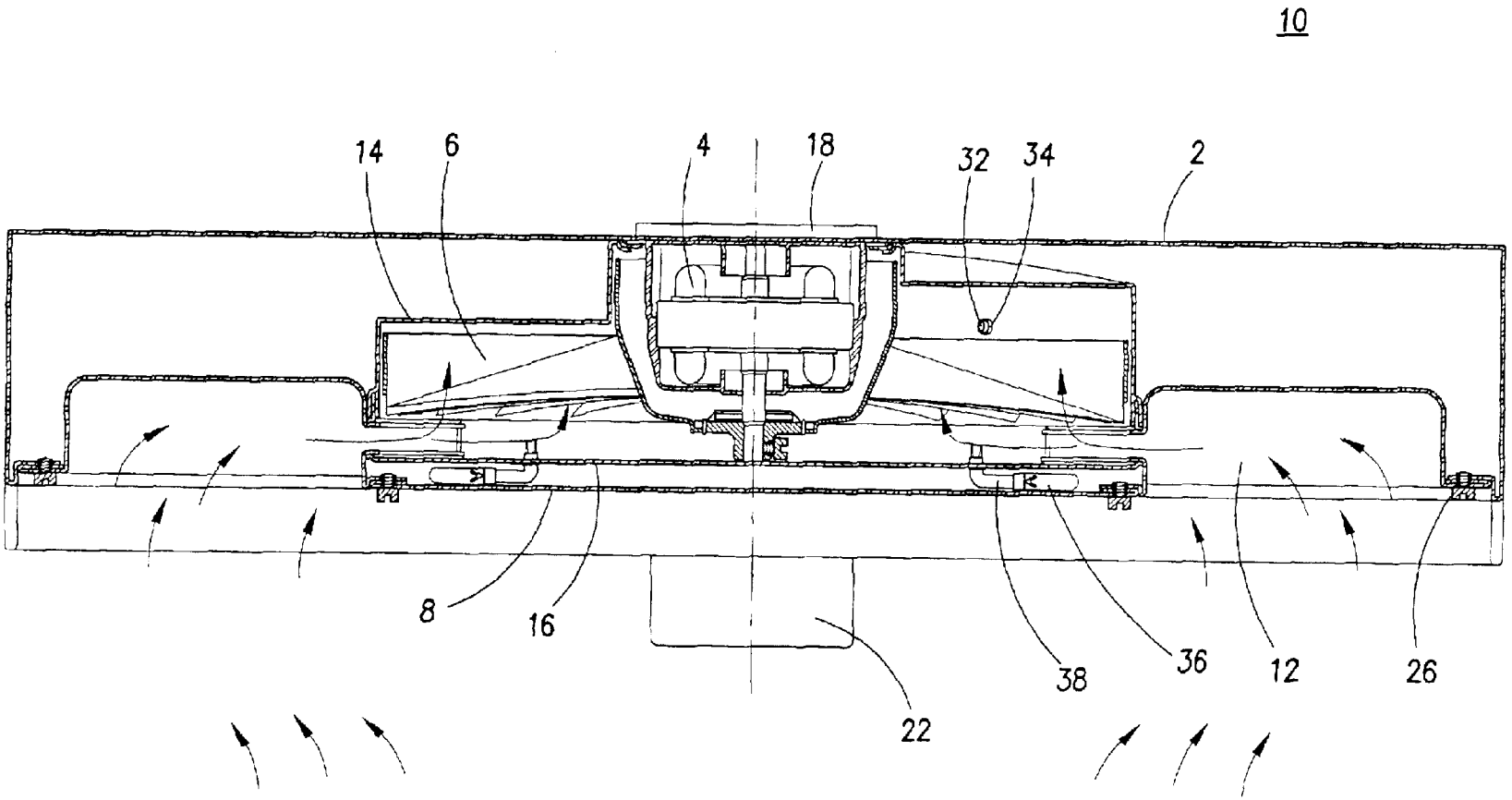
FIG. 4 is a front sectional view of the range hood shown in FIG. 1.

Motor housing 5 has an air outlet 18 located in upper section 14. When the motor housing 5 is mounted in place, air outlet 18 projects through an opening in the top surface of the hood body and is substantially centered between the sides as shown in FIG. 4.

The motor housing 5 also has at least one air inlet 20 in the lower section 16. Air inlet 20 is located about the perimeter of lower section 16. When multiple air inlets 20 are located in lower section 16, the air inlets are separated by intermediate members 21, which act to strengthen lower section 16.

In order to form a complete range hood enclosure, range hood 10 has peripheral air inlet framing panel 12 that is releasably connected to the hood body 2 and a lower panel 8 that is releasably connected to hood body 2 and the framing panel 12. Framing panel 12 comprises a substantially planar upper panel portion 24 having a peripheral wall 28 and an outer flange 30 depending therefrom. Flange 30 provides an edge for connecting the framing 12 to the hood body 2 and the lower panel 8 to the framing 12. Preferably these connections are accomplished by way of quick release screws 26. When the framing panel is connected to hood body 2, the upper panel portion is recessed from the lower edge of the range hood.

The framing panel 12 is shaped so as to fit about the motor housing 5, with a portion of peripheral wall 28 in abutment with the motor housing 5. Openings 23 in the peripheral wall 28 correspond in size, shape and alignment with air inlets 20 in the lower section 16 of the motor housing 5. Similarly, intermediate members 27 align with the intermediate members 21. Preferably, the openings 23 connect with the corresponding peripheral air inlets 20 as shown best in FIGS. 3 and 4.

The fan 6 is designed to draw air from one side of the fan, which as shown is below the fan, and force it towards the top of the motor housing and in the direction of rotation of the fan. Space between the top of the motor housing and the fan blades increases in the direction of rotation of the fan. Increasing the space between the fan 6 and the top surface of the motor housing in this fashion maximizes the air flow. When the motor 4 is activated, fan 6 is rotated thereby acting to draw air from below the fan. This creates an area of negative pressure below the fan. Air is therefore drawn in through the air inlets 20 and openings 23 in order to fill this area of negative pressure before being drawn into the fan 6 and forced out the air outlet 18. Gases rising from the cooking surface collect in the recessed area of the framing panel 12 and are sucked into the motor housing. Because the suction power of the motor housing is directed parallel to the bottom of the range hood, an increased amount of the cooking gases rising towards the range hood will be drawn in and exhausted as opposed to the prior art range hoods. Arrows depicting, the path of air entering the range hood 10 are shown in FIG. 4. Typically some form of conduit (not shown) leading to an exterior location is attached to air outlet 18 so as to provide proper venting of the gases drawn into the range hood.

As the greasy air passes through the motor housing some of the grease condenses on the interior surfaces and on the inlet framing 12. Grease on the inlet framing 12 may be easily wiped off as necessary. Grease within the motor housing drains to the bottom of the motor housing. The bottom surface of the motor housing is sloped from front to rear so liquids on its surface drain towards drainage hole 40 and then drain through hose 42 to external grease cup 22.

Figure 5:
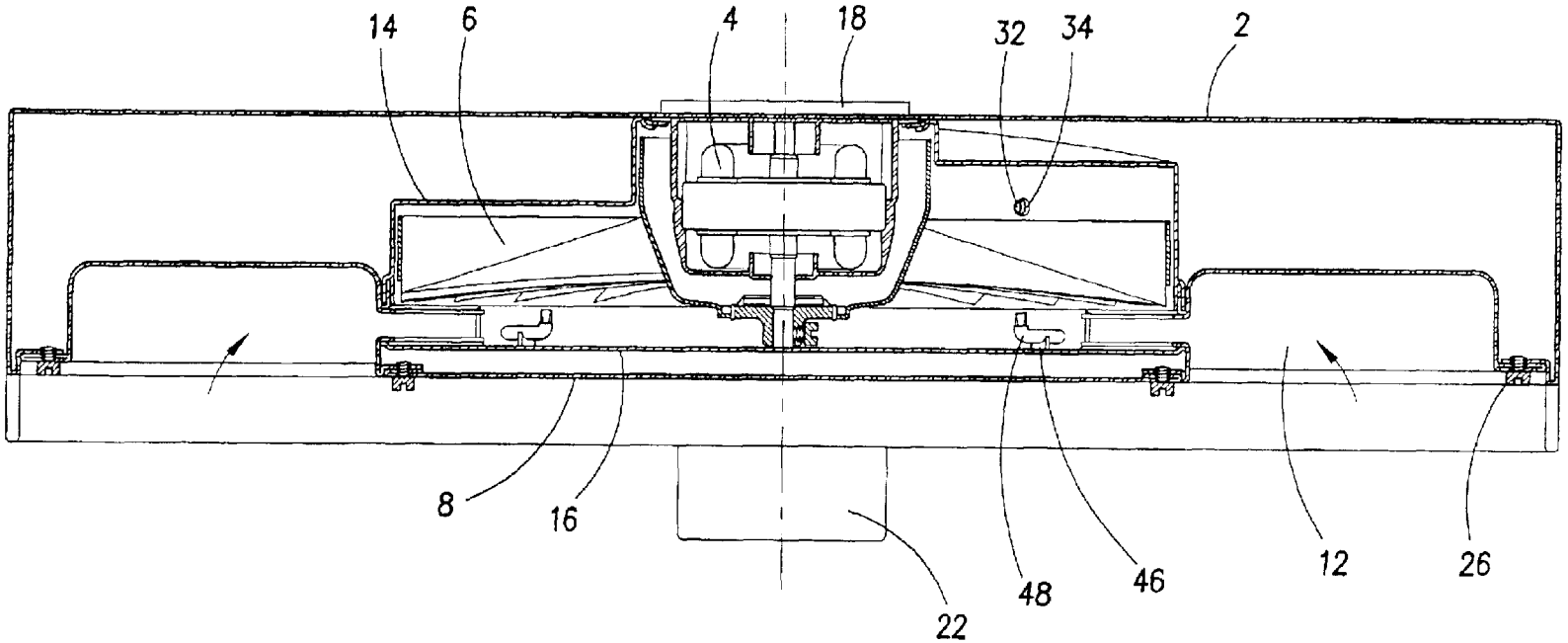
FIG. 5 is a front sectional view of the range hood shown in FIG. 1 having an alternative cleaning fluid spray delivery system.

In order to facilitate cleaning, a number of cleaning fluid dispensers may be mounted within the motor housing. Preferably the cleaning fluid dispensers comprise spray nozzles 38 mounted in the bottom of the motor housing so as to direct cleaning fluid towards the fan and motor housing interior. Conduits 36 are connected to the spray nozzles 38 and to a source of cleaning fluid (not shown) that is delivered under pressure. In addition, further spray nozzles 32 may be mounted in the upper section 14 of the motor housing 5. A sealing ring 34 or the like is used to prevent any air or grease from passing out of the motor housing in the area of the spray nozzles. Alternatively, as shown in FIG. 5, the spray nozzle 48 may pass through the side wall of lower section 16. In that case, spray nozzle 48 is preferably seated on a support stand 46 connected to the bottom of the lower section 16 of the motor housing 5. By raising the spray nozzle and conduit (not shown) above the level of the bottom of the motor housing, the stand 46 ensures that grease and liquid accumulating on the bottom of the motor housing are able to drain properly. A control system allows the cleaning system to be activated manually or automatically.

Figure 6:
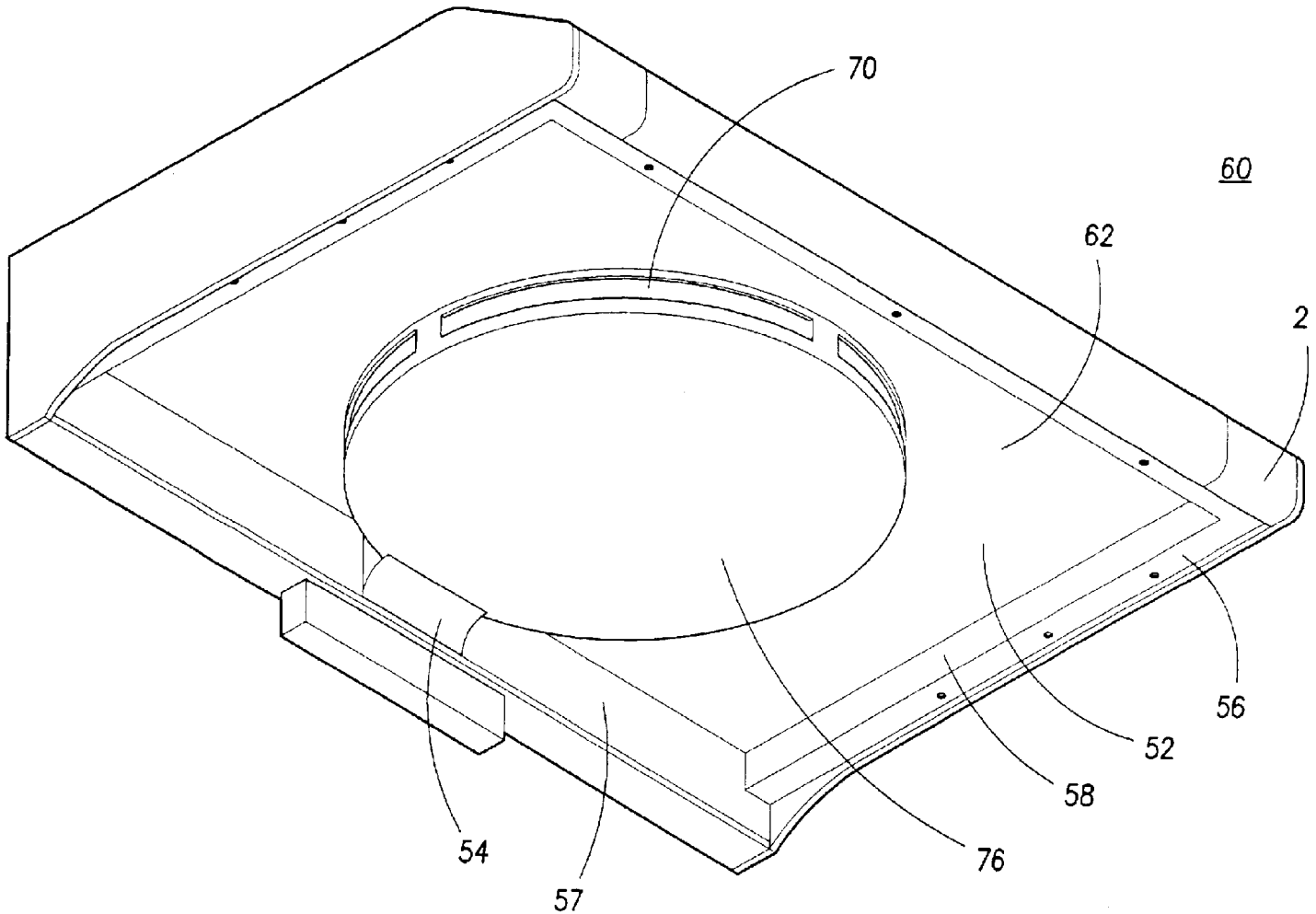
FIG. 6 is a perspective view from the bottom of an alternative embodiment of a range hood according to the invention.
Figure 7:
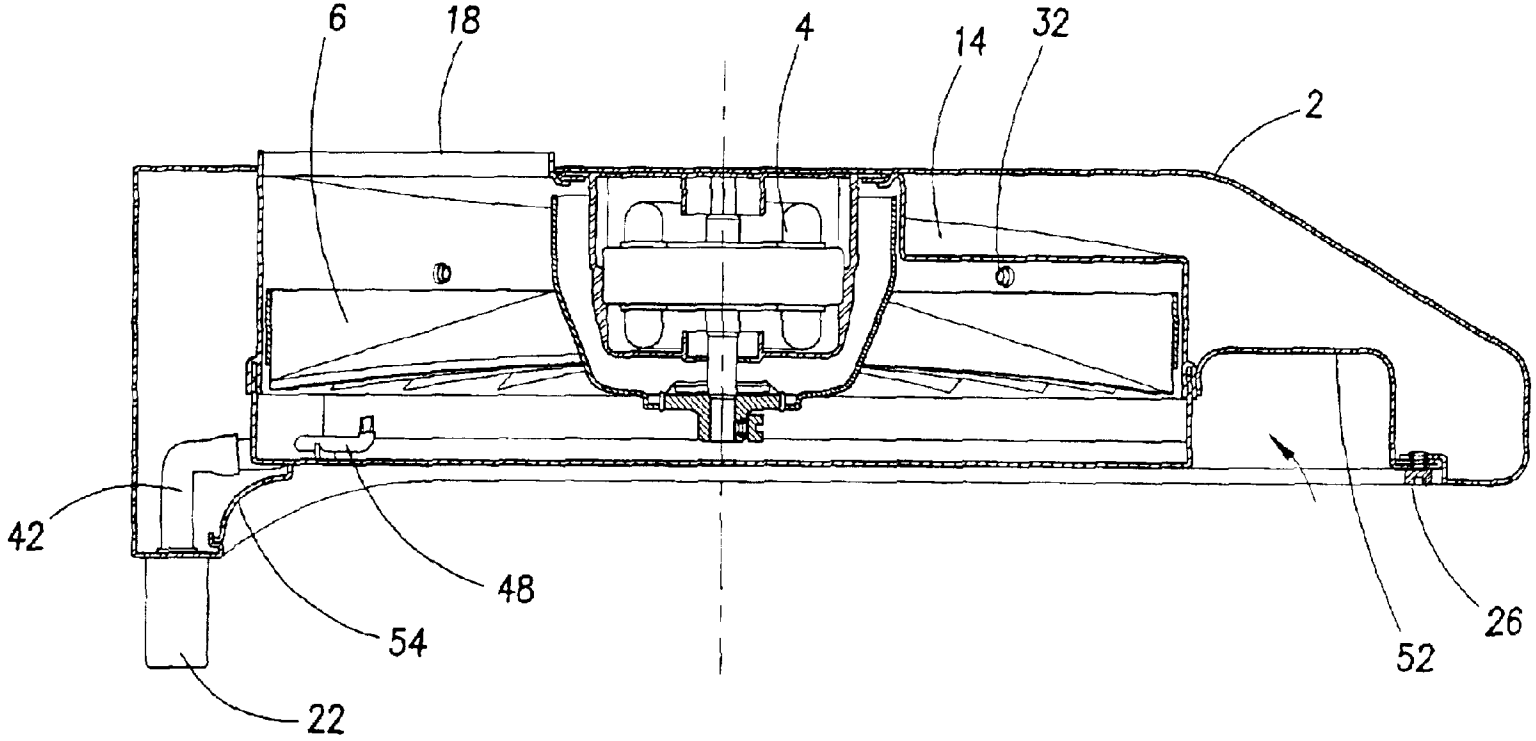
FIG. 7 is a cross sectional view of the range hood shown in FIG. 6.

In the alternative embodiment shown in FIGS. 6 and 7, the range hood 60 is not equipped with a lower panel as in the preferred embodiment described above. Instead, the framing 62 comprises an upper panel 52 generally rectangular in shape and having a peripheral wall 58 and flange depending from three sides. An opening in the upper panel 52 is sized and positioned so as to fit about the motor housing when the framing 62 is connected to the hood body 2. Towards the rear of the panel, there is an end wall 57 having a housing portion 54. Housing portion 54 provides additional spacing for the drainage hose and any cleaning fluid dispensers 48 passing through the side wall of lower section 76. This embodiment increases the suction area of the motor housing by increasing the size/number of the air inlets 70. However, it also reduces the available space for interior components of the range hood, such as wiring and cleaning fluid delivery systems.

Figure 8:
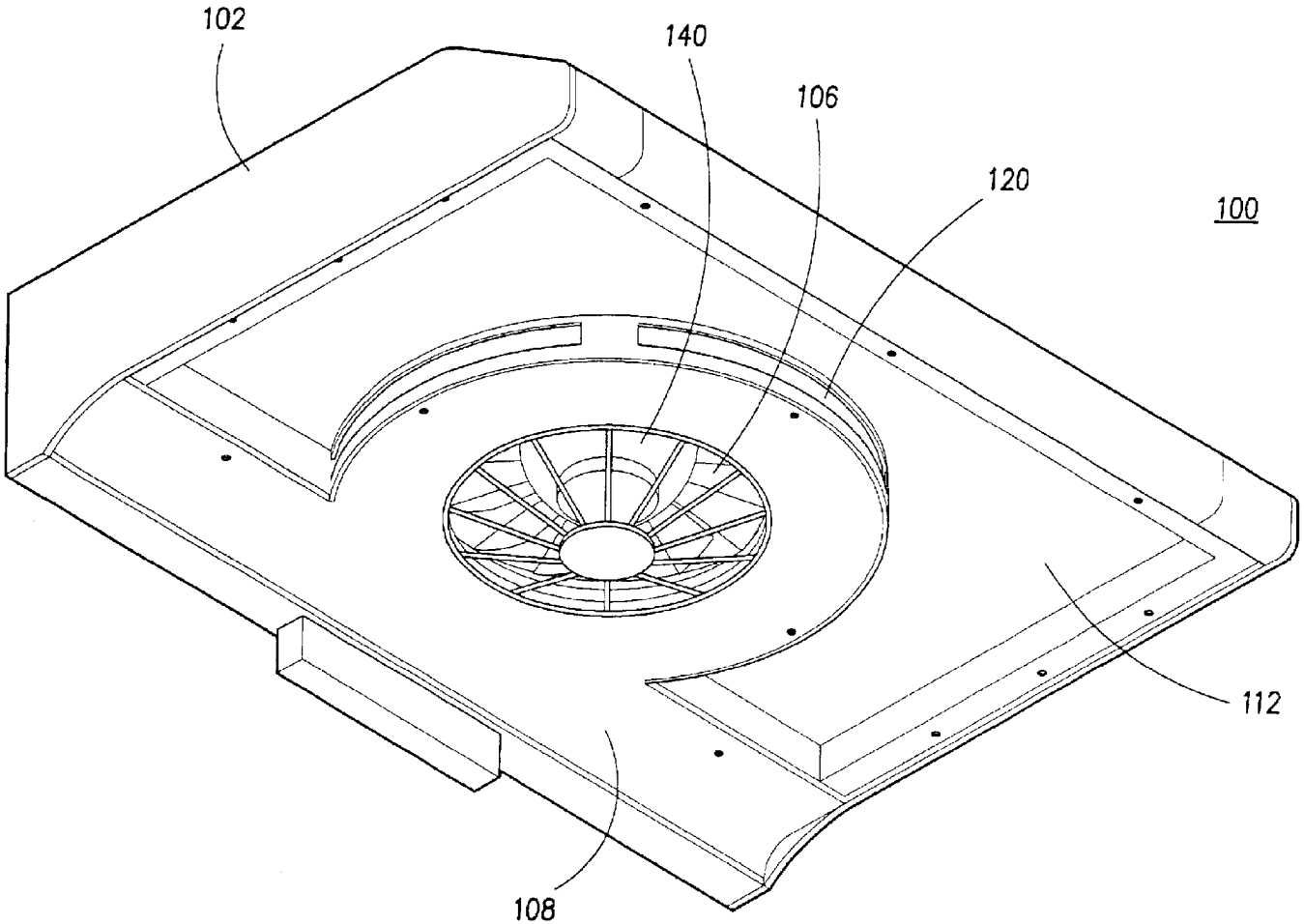
FIG. 8 is a perspective view from the bottom of a further alternative embodiment of a range hood according to the invention.
Figure 9:
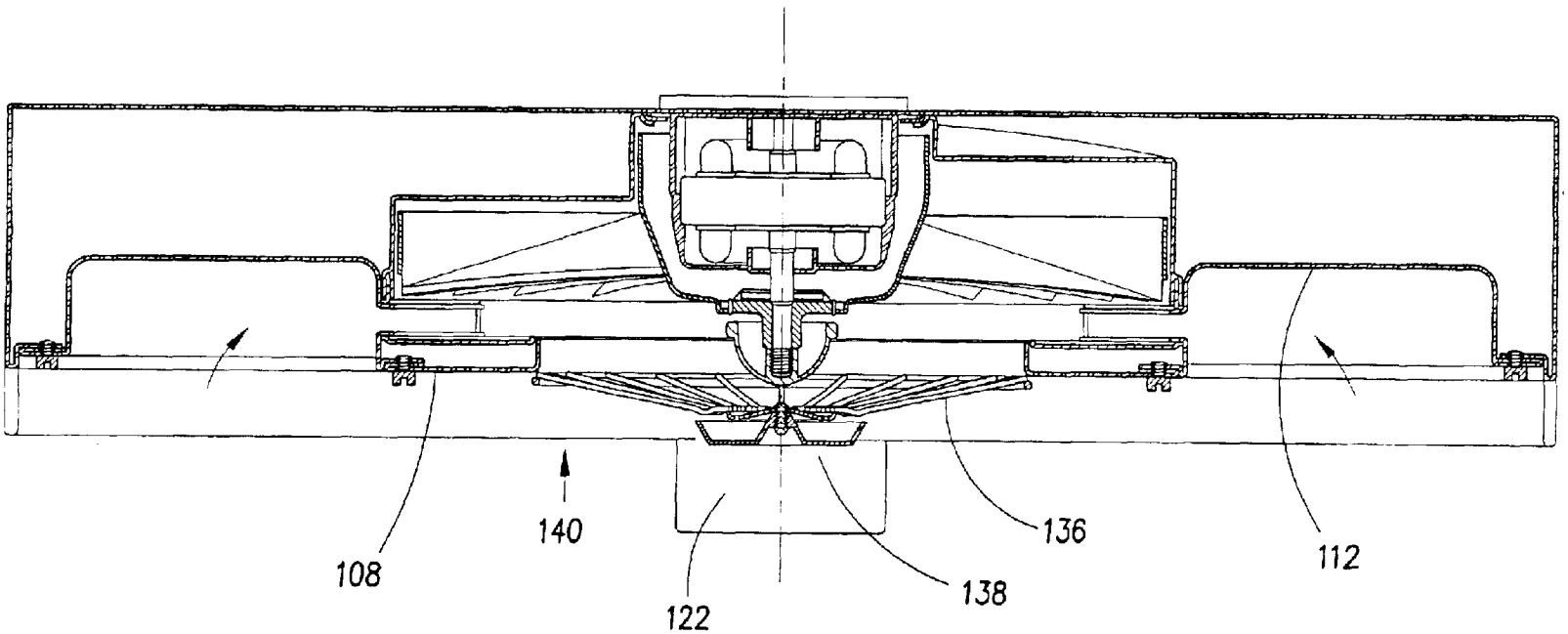
FIG. 9 is a cross sectional view of the range hood shown in FIG. 8.

A further alternative embodiment is shown in FIGS. 8 and 9. Range hood 100 is equipped with the peripheral air inlet system of the preferred embodiment. However, in addition to air inlets 120, peripheral air inlet framing panel 112 and lower panel 108, range hood 100 also has an air intake 140 located directly below the fan 106. Air intake 140 is formed by openings in both the bottom of the motor housing and in lower panel 108, the openings in alignment. Varying the size of air intake 140 varies the suction power of the air intake as compared to the air inlets 120. For example, decreasing the diameter of the air intake will decrease the amount of air being drawn in through the air intake 140 and increase the amount of air being drawn in through the air inlets 120. An increase in the diameter of the air intake 140 will have the opposite effect. For safety purposes, the range hood 100 is provided with a fan grill 136. A grease cap 122 is connected to the fan grill 136 in order to capture any grease draining down and dripping off the grill.

It will be appreciated by those skilled in the art that the preferred and alternative embodiments have been described in some detail but that certain modifications may be practiced without departing from the principles of the invention.

What is claimed is:

1. A range hood for exhausting gases comprising:

an outer hood body having top, front, rear and side surfaces and forming an enclosure;

a motor housing having top, bottom and perimeter surfaces defining an further enclosure and having an air outlet and at least one air inlet, said motor housing being mounted to said top surface of said hood, body within said enclosure defined by said hood body;

a motor and fan mounted within said motor housing;

wherein said at least one air inlet is located in said perimeter surface of said motor housing.

2. The range hood of claim 1 wherein an air intake is located in the bottom of said motor housing.

3. The range hood of claim 1 wherein said motor housing has a plurality of said air inlets, adjacent air inlets of said air inlets being separated by intermediate members.

4. A range hood for exhausting gases comprising:

an outer hood body comprising top, front, rear and side surfaces;

a motor housing having top, bottom and perimeter surfaces defining an enclosure and having an air outlet and at least one air inlet, said motor housing being mounted within said hood body;

a motor and fan mounted within said motor housing;

a framing panel connected to said hood body, a portion of said panel being in abutment with said motor housing; and wherein said at least one air inlet is located in said perimeter surface of said motor housing.

5. The range hood of claim 4 wherein said framing panel has a substantially planar portion and a peripheral wall substantially perpendicular thereto, said wall having at least one opening.

6. The range hood of claim 5 wherein said at least one opening in said wall is positioned and sized to align with said at least one air inlet.

7. The range hood of claim 4 further comprising a lower panel.

8. The range hood of claim 7 wherein said lower panel is connected to said framing panel and said hood body.

9. The range hood of claim 8 further comprising cleaning fluid delivery means.

10. The range hood of claim 9 wherein said cleaning fluid delivery means comprises a spray nozzle and a conduit connected to said spray nozzle.

11. The range hood of claim 10 wherein said spray nozzle is mounted in said motor housing.

12. The range hood of claim 10 wherein said spray nozzle is seated on a support stand mounted within said motor housing.

* * * * *